US010768573B2

(12) United States Patent
So et al.

(10) Patent No.: US 10,768,573 B2
(45) Date of Patent: Sep. 8, 2020

(54) PROCESS CARTRIDGE AND ELECTROPHOTOGRAPHIC IMAGE FORMING APPARATUS

(71) Applicant: PRINT-RITE • UNICORN IMAGE PRODUCTS CO., LTD. OF ZHUHAI, Zhuhai, Guangdong (CN)

(72) Inventors: Kinkeung So, Guangdong (CN); Xiaofeng Yang, Guangdong (CN); Wenyi Ding, Guangdong (CN)

(73) Assignee: PRINT-RITE, UNICORN IMAGE PRODUCTS CO., LTD. OF ZHUHAI, Zhuhai (CN)

( * ) Notice: Subject to any disclaimer, the term of this patent is extended or adjusted under 35 U.S.C. 154(b) by 0 days.

(21) Appl. No.: 16/351,735

(22) Filed: Mar. 13, 2019

(65) Prior Publication Data

US 2019/0286050 A1 Sep. 19, 2019

(30) Foreign Application Priority Data

Mar. 14, 2018 (CN) ..... 2018 1 0209109
May 25, 2018 (CN) ..... 2018 1 0515023

(51) Int. Cl.
*G03G 15/00* (2006.01)
*G03G 21/18* (2006.01)

(52) U.S. Cl.
CPC ..... *G03G 21/186* (2013.01); *G03G 21/1814* (2013.01); *G03G 21/1842* (2013.01)

(58) Field of Classification Search
CPC ..... G03G 21/186; G03G 21/1814; G03G 21/1842; G03G 21/1857
See application file for complete search history.

(56) References Cited

U.S. PATENT DOCUMENTS

2014/0023396 A1* 1/2014 Shiobara ..... G03G 15/757 399/167

FOREIGN PATENT DOCUMENTS

CN 101583910 11/2009

* cited by examiner

*Primary Examiner* — Hoang X Ngo
(74) *Attorney, Agent, or Firm* — Cozen O'Connor

(57) ABSTRACT

A process cartridge and an electrophotographic image forming apparatus. The process cartridge includes a cartridge body, a photosensitive drum having a first axis, and a driving force receiving member having a second axis. The photosensitive drum is rotatably supported between two end walls of the cartridge body, and the driving force receiving member has a head portion and a shaft portion. The driving force receiving member is connected to an axial end of the photosensitive drum through an Oldham coupling; a rotation angle limiting mechanism is disposed between the driving force receiving member and the photosensitive drum; and the driving force receiving member is movable in a direction perpendicular to the first axis and rotatable around the second axis such that the second axis is either co-axial or parallel with the first axis.

17 Claims, 8 Drawing Sheets

Detail A

PROCESS CARTRIDGE AND ELECTROPHOTOGRAPHIC IMAGE FORMING APPARATUS

BACKGROUND OF THE INVENTION

1. Field of the Invention

The present invention relates to an electrophotographic image forming apparatus, and a process cartridge detachably mounted in the electrophotographic image forming apparatus.

2. Description of the Related Art

Referring to FIG. 1, an electrophotographic image forming apparatus 1 such as a laser printer or a multifunctional all-in-one laser printer usually uses a process cartridge 2 as an image processing apparatus. FIG. 1 is used as a schematic view, and is only used to show that the process cartridge 2 can be mounted along a Y direction to a cartridge containing chamber of a main assembly of the electrophotographic image forming apparatus 1 or taken out in an opposite direction. The process cartridge 2 is usually mounted or taken out by using a slide groove on a pair of vertical walls in the cartridge containing chamber of the electrophotographic image forming apparatus 1. As shown in FIG. 1, a right vertical wall is provided with a rotation force driving head 12, and a guide plate 11 that is parallel to the vertical wall and that is spaced from the vertical wall. The guide plate is used to guide a connection member in a patent document with the publication number of CN101583910B and the invention title of Rotational Force Transmission Part. One end of the connection member is hingedly connected to one end of a photosensitive drum by using a spherical hinge. The connection member is a driving force receiving member, which has a shaft portion and a head portion. A pair of engaging teeth is disposed on the head portion. When the process cartridge is inserted into the cartridge containing chamber generally in the Y direction, that is, a direction that is perpendicular to the X direction in FIG. 1, the driving force receiving member rotates around the spherical hinge and sags due to the effect of gravity. An angle is formed between the axis of the connection member and the axis of the photosensitive drum. When the connection member touches the guide plate 11, the driving force receiving member is lifted and is engaged with a rotational force driving member or driving head 12, so as to drive the process cartridge to work. That is, the function of the guide plate 11 is to guide the connection member to change the foregoing angle, so that the connection member is engaged with the rotational force driving head; and when the process cartridge 2 is taken out of the cartridge containing chamber, the guide plate 11 guides disengagement between the connection member and the rotational force driving head. This driving connection structure has the following defect: firstly, the spherical hinge structure is easily detached, and secondly, when the process cartridge is not mounted into the cartridge containing chamber, the connection member is like a part hanging on the cartridge containing chamber side, and can be easily damaged, leading to loss of the function or unstable work of the connection member.

To avoid the foregoing defect of spherical hinge connection, a lot of patent documents disclose a connection scheme that a driving force receiving member, namely, a connection member can generate relative displacement in an axis direction relative to a photosensitive drum; that is, the driving force receiving member and the photosensitive drum are set to be coaxial, and can perform relative movement in the axial direction; when moving to a first position, the driving force receiving member is engaged with the rotational force driving member or driving head 12, and when moving to a second position, the driving force receiving member is disengaged from the rotational force driving member 12. However, this connection structure is relatively complex and the process of placing a process cartridge into a cartridge containing chamber for connection and taking it out for disconnection are not smooth enough.

The foregoing two existing technical solutions have one thing in common, that is, when the rotational force driving head is not engaged with the driving force receiving member, by means of inward retraction of the driving force receiving member towards the process cartridge or by means of inclination of the driving force receiving member towards one side, projection points of engaging teeth of the driving force receiving member on the axis of the photosensitive drum get away from the rotational force driving head; after the process cartridge enters the cartridge containing chamber or in the entering process, the driving force receiving member extends out or eliminates inclination, so that the projection points of the engaging teeth on the axis of the photosensitive drum achieve the length needed for engagement with the rotational force driving head.

SUMMARY OF THE INVENTION

A principal object of the present invention is to provide a process cartridge, and an electrophotographic image forming apparatus to which the process cartridge is detachably mountable, capable of solving the above described problems of the conventional process cartridges.

Another object of the present invention is to provide a process cartridge capable of smoothly rotating a photosensitive drum by being mounted in an alternative way to a main assembly provided with no mechanism for moving a main assembly side coupling member, in its axial line direction, for transmitting a rotational force to the photosensitive drum.

A further object of the present invention is to provide a process cartridge demountable in an alternative way from a main assembly of an electrophotographic image forming apparatus provided with a driving head in a direction perpendicular to an axial line of the driving shaft.

A further object of the present invention is to provide a process cartridge mountable in an alternative way to a main assembly of an electrophotographic image forming apparatus provided with a driving head in a direction substantially perpendicular to an axial line of the driving head.

A further object of the present invention is to provide a process cartridge mountable to and demountable from a main assembly of an electrophotographic image forming apparatus provided with a driving head in a direction substantially perpendicular to an axial line of the driving head.

According to the present invention, there is provided a process cartridge which can be demounted smoothly from a main assembly of an electrophotographic image forming apparatus provided with the driving head in a direction substantially perpendicular to an axis of a driving head According to the present invention, there is provided a process cartridge mountable easily, in a direction substantially perpendicular to an axis of a driving head, to a main assembly of an electrophotographic image forming device provided with the driving head.

According to the present invention, there is provided a process cartridge which can be mounted and dismounted smoothly, in a direction substantially perpendicular to an axis of a driving head, to a main assembly of an electrophotographic image forming apparatus provided with the driving head.

According to the present invention, a process cartridge is mounted to a main assembly which is not provided with a mechanism for moving a main assembly side drum coupling member for transmitting a rotational force to a photosensitive drum to an axial direction, and can rotate the photosensitive drum smoothly.

According to the present invention, a process cartridge can be demounted in a direction substantially perpendicular to an axis of a driving head provided in a main assembly, and simultaneously, the smooth rotation of a photosensitive drum can be carried out.

According to the present invention, a process cartridge can be mounted in a direction substantially perpendicular to an axis of a driving head provided in a main assembly, and simultaneously, the smooth rotation of a photosensitive drum can be carried out.

According to the present invention, a process cartridge is mountable and dismountable in a direction substantially perpendicular to an axis of a driving head provided in a main assembly, and simultaneously, the smooth rotation of a photosensitive drum can be carried out.

These and other objects, features, and advantages of the present invention will become more apparent upon consideration of the following description of the preferred embodiments of the present invention, taken in conjunction with the accompanying drawings.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

Figure 1:
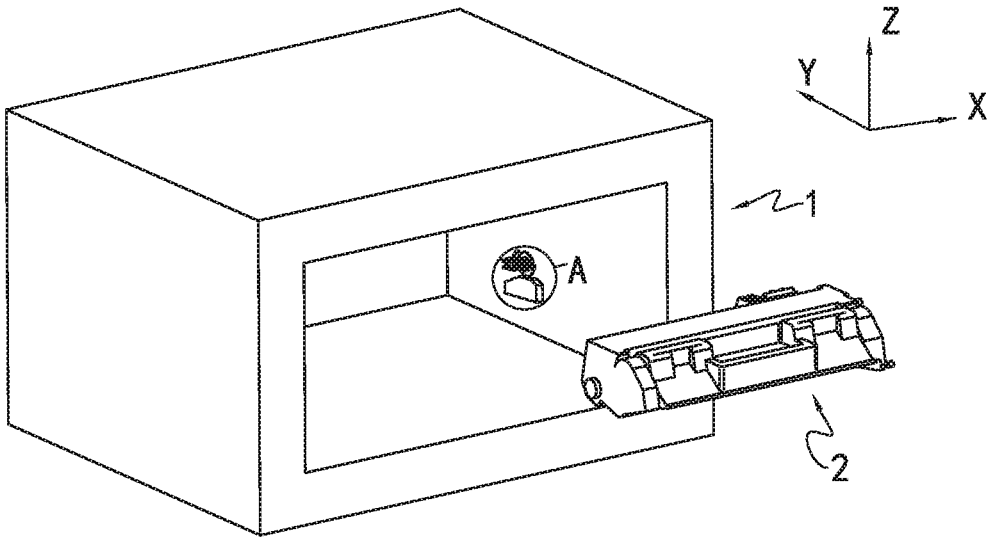
FIG. 1 is a schematic view illustrating an assembly relationship between an electrophotographic image forming apparatus and a process cartridge.
Figure 2:
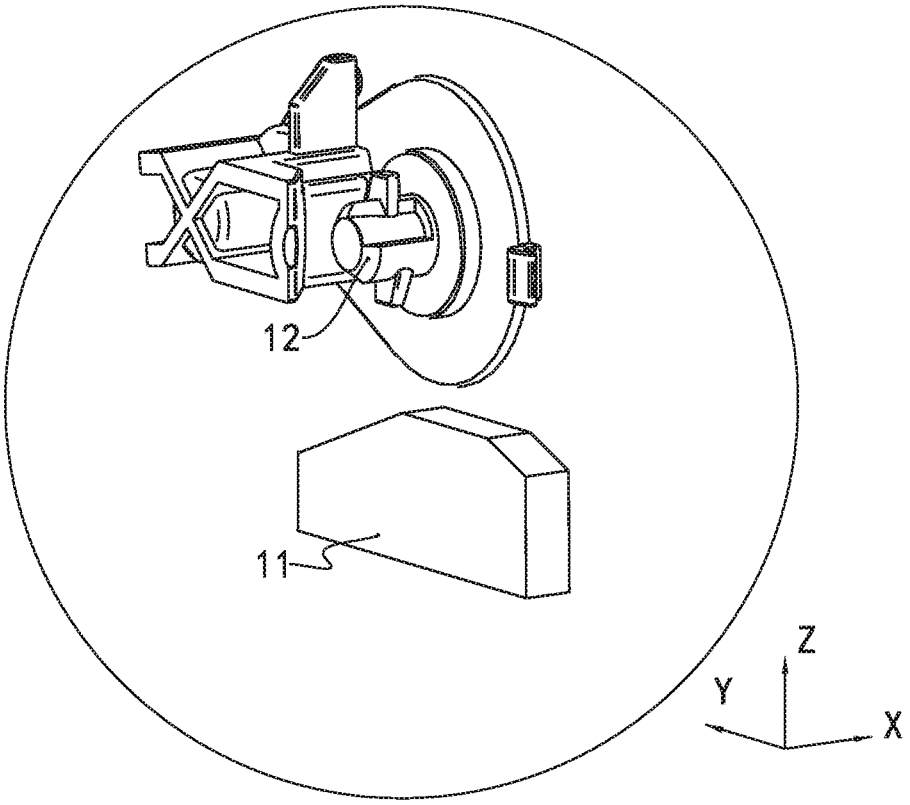
FIG. 2 is a partial enlarged view of Part A in FIG. 1.

The present invention is further described below with reference to the accompanying drawings and embodiments.

DETAILED DESCRIPTION OF THE PRESENTLY PREFERRED EMBODIMENTS

In order to more clearly describe the relative position relationship and operational relationship between the parts in the embodiments, most of the drawings of the present invention show a three-dimensional coordinate system with uniform directions. This is intended to indicate that when the angles of view of the parts in the drawings are different, the parts described thereby still have a uniform coordinate directionality and are cited in the following description. In addition, taking into account the size limitation of the drawing, the same parts are not uniformly proportioned in different drawings, only to describe the present invention more clearly.

An electrophotographic image forming apparatus of the present invention uses a cartridge containing chamber for placing and taking a process cartridge. An opening of the cartridge containing chamber may be on a top surface of the apparatus, or on a side surface of the apparatus, and a cartridge containing chamber cover or a cartridge containing chamber door may also be disposed. However, the main characteristics are all in the structure of the process cartridge. Therefore, the implementations of only the process cartridge of the present invention are described below. The electrophotographic image forming apparatus may be a laser printer, an all-in-one (multifunction) laser printer, or the like. Details are not described again.

Only the specific structure of the process cartridge of the present invention and a connection relationship with an existing structure are described below. The structure and parts that are the same as those of the existing process cartridge can be implemented by a person skilled in the art with reference to the prior art.

First Embodiment of a Process Cartridge

Figure 3:
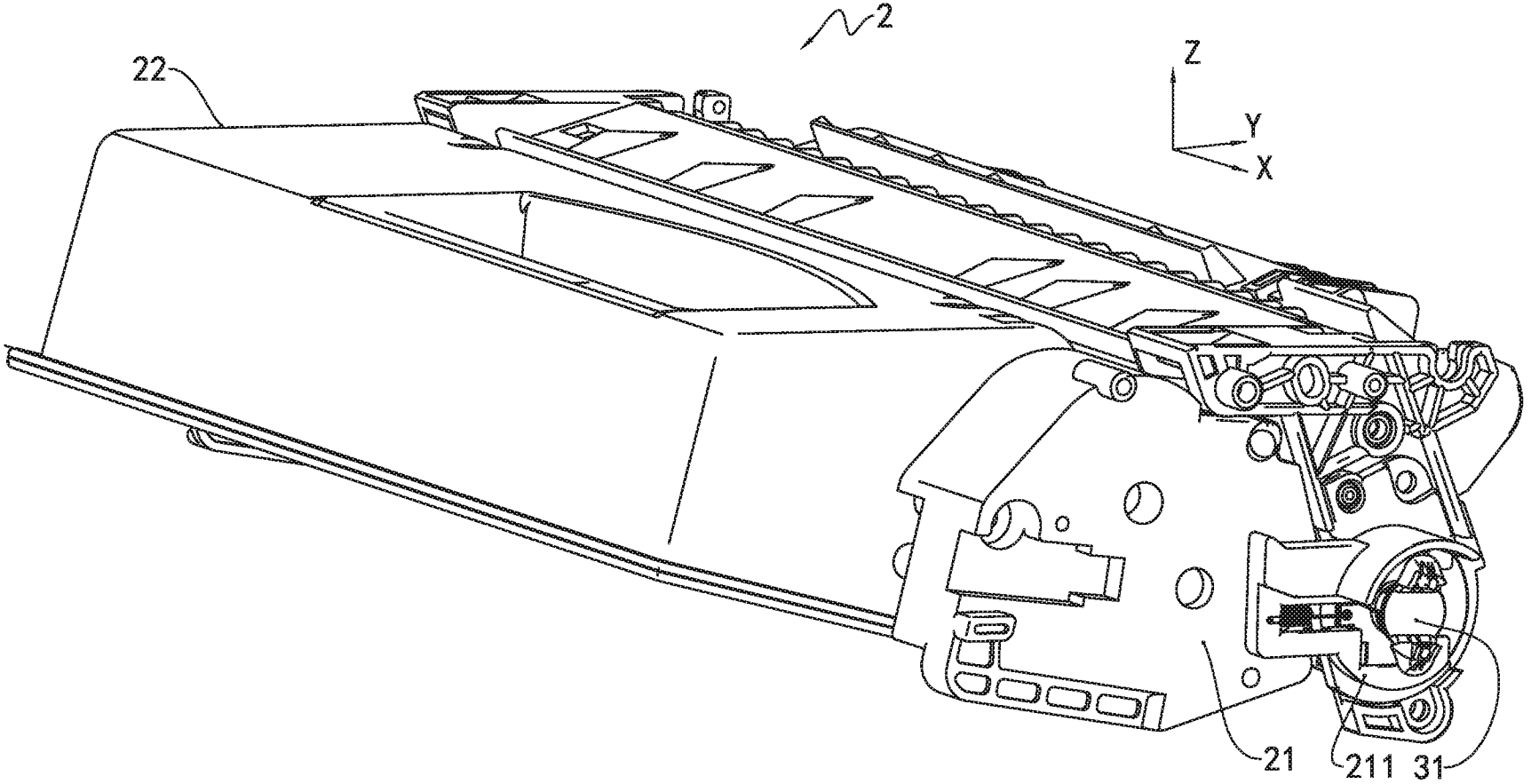
FIG. 3 is a perspective view of a first embodiment of a process cartridge of the present invention.

Referring to FIG. 3, a process cartridge 2 includes a cartridge body having two end walls 21 and 22 respectively in the longitudinal direction of the cartridge. The process cartridge also includes a photosensitive drum, which is rotatably supported between the two end walls 21 and 22. The photosensitive drum is rotatable around its axis. A driving force receiving member 31 is provided at an axial end of the photosensitive drum. The driving force receiving member 31 would be coupled to the driving head 12 to receiving a driving torque for the photosensitive drum when process cartridge is mounted on the electrophotographic image forming apparatus 1. Both the axis of the photosensitive drum and the axis of the driving force receiving member 31 are extended along X direction. It would be best that in a free state and a torque transmission state, the axis of the photosensitive drum and the axis of the driving force receiving member 31 are co-axial. By this, the driving force transfer would be very stable and smooth. A bearing plate 211 is provided adjacent to the driving force receiving member 31 to support one end of the photosensitive drum. It is preferable that the bearing plate 211 is made as an independent finished piece and is fixed to the end wall 21 so that it becomes a part of the end wall 21.

Figure 4:
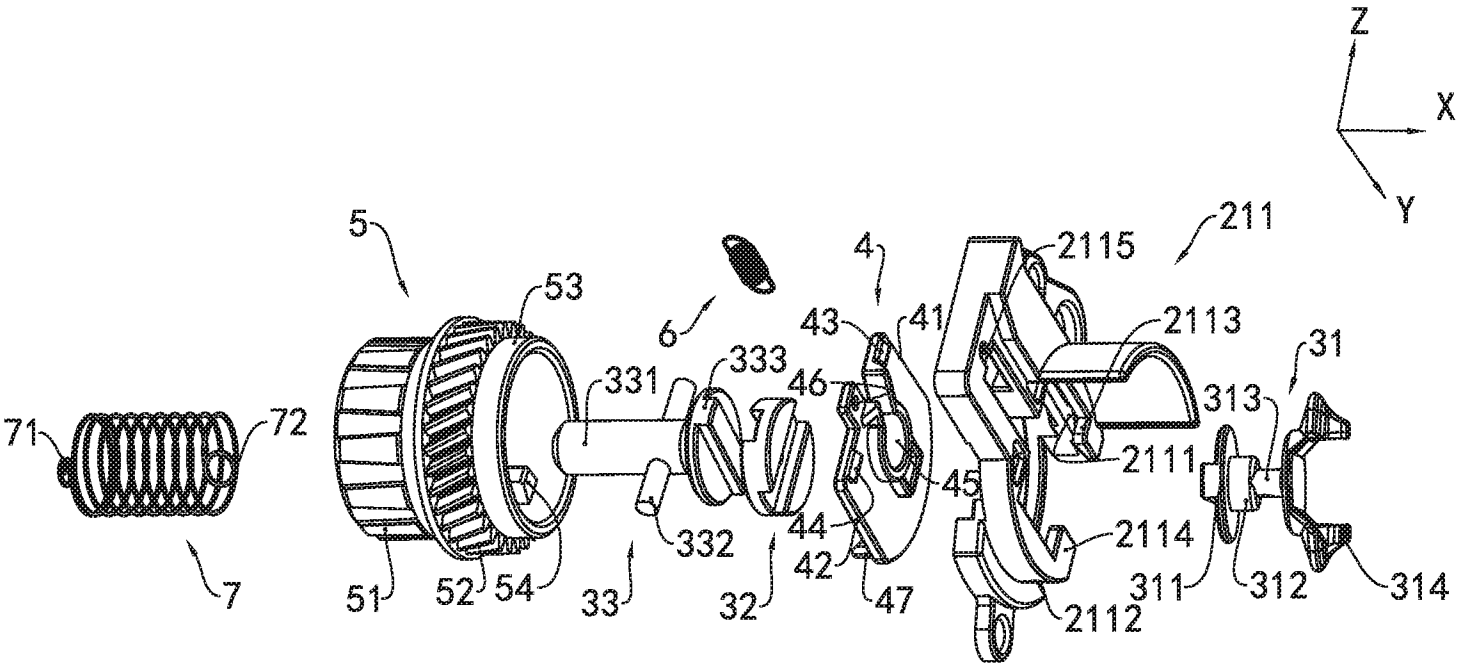
FIG. 4 is a structural exploded view of a driving force receiving member, an Oldham coupling, and a rotation angle limiting mechanism in the first embodiment of the process cartridge.

Referring to FIG. 4, a drum gear 5 used as a shaft at one end of the photosensitive drum is a general barrel-shaped hollow cylinder. It is provided sequentially, along the X or the axial direction, with a connection end 51 that is fixedly connected to a drum cylinder, a helical gear portion 52, and a shaft portion 53 that is supported on a bearing seat 2116 of the bearing plate 211 (referring to FIG. 6).

The driving force receiving member 31 is provided with a driving force receiving portion that includes a pair of engaging teeth 314, a driving force transmitting portion 311 that functions as an force outputting portion for the driving force receiving member 31, and a shaft portion that connects the driving force receiving portion and the driving force transmitting portion and includes an engaging portion 312 and a guided portion 313. The driving force receiving portion is also called the head portion.

Driving force received by the driving receiving member 31 will be transmitted to the drum gear 5 through a slide member 32 and a force transmission rod 33. The driving force transmitting portion 311 of the driving force receiving member 31, the slide member 32 and a right shaft end 333 of the force transmission rod 33 constitute an Oldham coupling of the present invention. Along the axial direction, i.e. the X direction, the driving force transmitting portion 311 is positioned at an outer position, so it is also called an outer coupling of the Oldham coupling; while the right shaft end 333 is positioned at an inner position, so it is also call an inner coupling of the Oldham coupling.

The force transmission rod 33 is provided with a left shaft end 331 that is opposing the right shaft end 333, and a pair of force transmitting arms 332 that transfer the driving force from the Oldham coupling to the drum gear 5. The pair of force transmitting arms 332 is configured to engage with a pair of protruding bars 54 that are disposed symmetrically at an inner wall of the drum gear 5.

Figure 7:
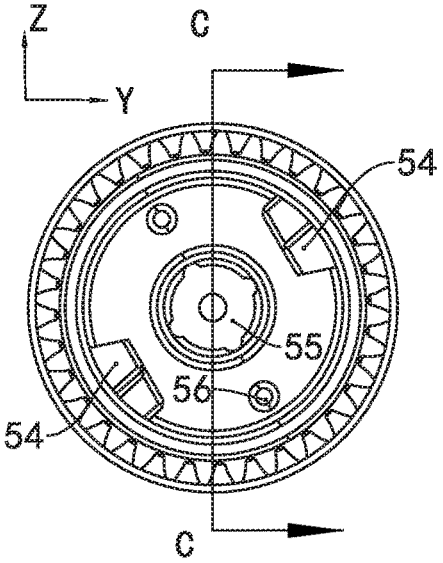
FIG. 7 is a structural view of a gear head of an end portion of a photosensitive drum.

The shaft end 331 is seated in a shaft seat 55 provided at the inner bottom of the drum gear 5 (referring to FIG. 7). Around the left shaft end 331, a torsion spring 7 is provided to define an original position of the force transmission rod 33 in a circumferential direction at the very beginning. One end 71 of the torsion spring 7 is fixed to a spring mounting column 56 (referring to FIG. 7) provided at the inner bottom of the drum gear 5, and the other end 72 is fixed to one of the force transmitting arms 332.

The force transmission rod 33 is co-axial and rotatable with respect to the drum gear 5. It can rotate in a clockwise direction or in an anti-clockwise direction from its original position where the force transmitting arms 332 are in some distance away from the protruding bars 54 respectively to a contact position where the force transmitting arms 332 engage with the protruding bars 54 respectively. By this, the rotation angle of the force transmitting arms 332 are defined by the protruding bars 54. This constitutes a rotation angle limiting mechanism. As the driving force receiving member 31 is connected with the force transmission rod 33, the rotation angle of the driving force receiving member 31 is also defined by this rotation angle limiting mechanism.

The bearing plate 211 is fixed on the end wall 21 of the cartridge body by using a fastening member, to support the photosensitive drum, as well as to enable, by using a sliding plate 4, the force transmission rod 33, the slide member 32, and the driving force receiving member 31 to be limited between the drum gear 5 and the sliding plate 4 in the X direction.

The sliding plate 4 is provided with a pair of straight slide rails 41 and 42 that matche a pair of slide grooves 2111 and 2112 of the bearing plate 211 in a sliding manner so that it can relatively slide in an radial direction, i.e. the sliding direction. As the sliding direction here has a small angle with respect to the Y direction, we may say the sliding direction is generally the Y direction, in order to make the description more conveniently, we describe the sliding direction also the Y direction. It is understood that the sliding plate 4 may slide in another radial direction rather than the Y direction; and the same result will still be achieved.

The sliding plate 4 is also provided with a round hole 45 that is in clearance fit with engaging portion 312 of the driving force receiving member 31 so that when one of the sliding plate 4 and the driving force receiving member 31 moves in the Y direction, the other of the sliding plate 4 and the driving force receiving member 31 will move in the Y direction accordingly.

The sliding plate 4 is further provided with a pair of protrusions 43 and 44 which are positioned for matching a pair of limiting stops 2113 and 2114 of the bearing plate 211 to limit a pull-out stroke in the Y direction of the sliding plate 4 relative to the bearing plate 211. When the protrusions 43 and 44 abut against the limiting stops 2113 and 2114, the sliding plate 4 is located at a second position that will be described hereinafter.

The sliding plate 4 is further provided with an arc plate 47 that extends in a direction opposite to the X axis and is used for limiting the retraction of the sliding plate 4 relative to the bearing plate 211. When it slides back until the arc plate 47 contact a contacted portion of the cartridge, the sliding plate 4 is back to a first position that will be described hereinafter.

As an elastic member of the present invention, a draw spring 6 is disposed between the sliding plate 4 and the bearing plate 211. One end of the draw spring 6 is fixed to a hook hole 46 provided on the sliding plate 4, and the other end is fixed to a hook hole 2115 provided on the bearing plate 211, and a restoring force thereof forces the sliding plate 4 from the second position back to the first position.

As mentioned above, the driving force receiving member 31 is movable in a direction perpendicular to the axis of the drum and is also rotatable around its own axis, so in case there is some jam or clamping between the driving force receiving member and the driving head during cartridge mounting or demounting process, the driving force receiving member 31 is able to adjust its postures and/or its places with respect to the drum gear or to driving head of the printer so as to avoid such jam or clamping easily. Therefore, with these kinds of configuration, the process cartridge can be mounted to or demounted from the printer smoothly.

And further, as the driving force receiving member 31 moves in the direction perpendicular to the axis of the drum and rotates around its own axis compared with other parts of the process cartridge, the position(s) of the engaging teeth 314 as measured in the axis direction of the drum remains unchanged, one the other side, the position(s) of the engaging teeth 314 is changeable in the Y-Z projection plane, or viewing upon the X direction. This makes it easy for the engaging teeth change its positions when it confronts the driving head 12 during the cartridge mounting and demounting process.

Figure 5:
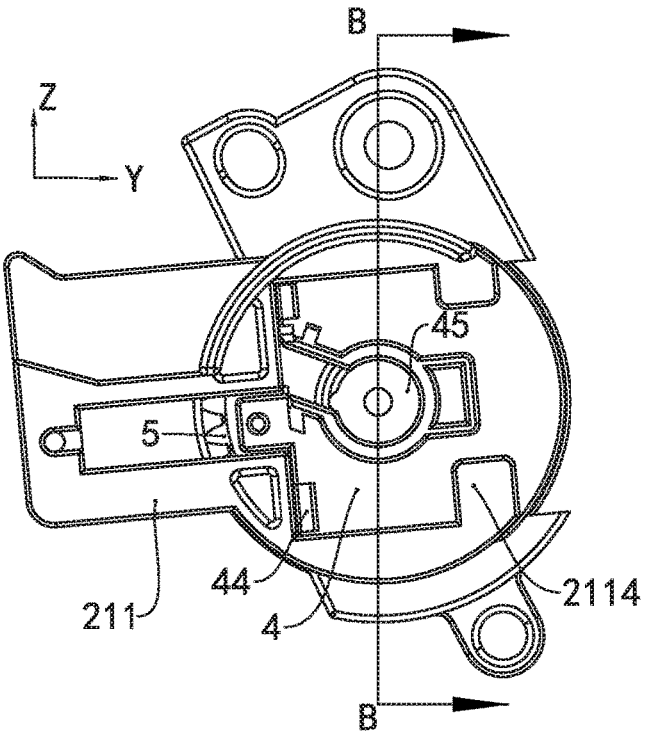
FIG. 5 is a view illustrating a relationship between a sliding plate and end walls of a process cartridge.
Figure 6:
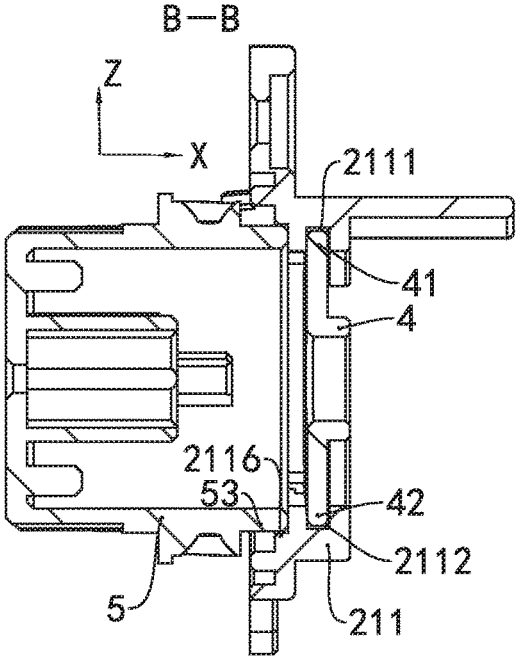
FIG. 6 is a B-B sectional view of FIG. 5.

Referring to FIG. 5 and FIG. 6, FIG. 5 shows that the sliding plate 4 is located at the first position relative to an end wall of the cartridge body, that is, the bearing plate 211, and the center of the round hole 45 is located on the axis of the drum gear 5. FIG. 6 shows a sliding matching relationship between a pair of slide rails 41 and 42 of the sliding plate 4 and a pair of slide grooves 2111 and 2112, and the state in which the shaft portion 53 of the drum gear 5 is supported on the bearing seat 2116.

Figure 8:
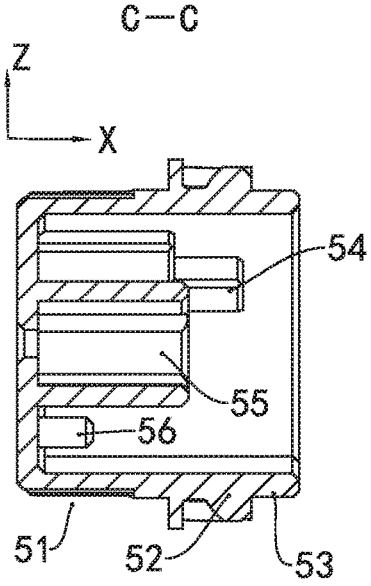
FIG. 8 is a C-C sectional view of FIG. 7.

Referring to FIG. 7 and FIG. 8, FIG. 7 and FIG. 8 show the structure of the drum gear 5. There is provided two spring mounting columns 56, in order to achieve dynamic balance during rotation of the photosensitive drum; however, as mentioned above, only one of the two is connected with the end 71 of the torsion spring 7. As discussed above, the protruding bars 54 mainly have two functions, one is for limiting the rotation angle of the force transmitting arms 332, and the other is to receive the torque transmitted by the force transmitting arms 332. The inner circle of the drum gear 5 is divided by the protruding bars 54 into two intervals. It is understood that each force transmitting arm 332 is disposed and positioned in one of the intervals, so the maximum rotation angle for any of the force transmitting arms 332 begins at the place where the force transmitting arm 332 contacts one of the protruding bars 54 and ends at the place where the force transmitting arm 332 contacts the other of the protruding bars 54. The shaft seat 55 is formed by a cylinder hole and it is in clearance fit with the left shaft end 331, as well as limits the force transmission rod 33 in the X direction.

Figure 9:
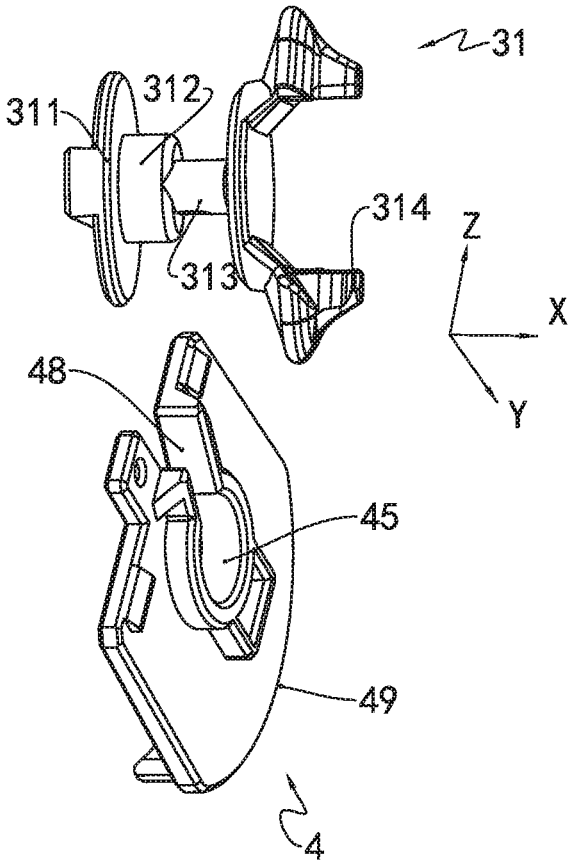
FIG. 9 is a schematic view illustrating an assembly relationship between a sliding plate and a driving force receiving member.

Referring to FIG. 9, to solve the assembly problem when the driving force receiving member 31 is integrally manufactured, the sliding plate 4 is provided with a guiding slot 48 that extends from an edge of the sliding plate 4 to the round hole 45. The shaft portion of the driving force receiving member 31 is provided with two portions, i.e. an engaging portion 312 that is formed by a cylinder portion and has a circular section, and a guided portion 313 that is formed by an elliptical cylinder portion and has an oval section. Viewing opposing the X direction, i.e. on a YZ projection plane, an imaginary connection line between the pair of engaging teeth 314 of the driving force receiving member 31 is perpendicular to the long axis of the elliptical cylinder portion 313 of the shaft portion thereof, so as to further avoid the clamping phenomenon.

It is preferable that the width of the guiding slot 48 is slightly greater than the length of the short axis of oval section of the guided portion 313 so that it is convenient for the guided portion 313 passes through the guiding slot 48 to make the engaging portion 312 align with the round hole 45, and after the engaging portion 312 engages with the round hole 45, the engaging portion 312 can not escape through the guiding slot 48. More specifically, the driving force receiving member 31 may be inserted into the sliding plate 4 by aligning the long axis of the of oval section of the guided portion 313 with the guiding slot 48, and after reaching the round hole 45, the driving force receiving member 31 moves in the X axial direction relative to the sliding plate 4, to make the cylinder portion 312 engage with the round hole 45 completely.

At the leading edge of the sliding plate 4 with respect to the cartridge mounting direction, a front end 49 having an arc-shaped edge is provided. When the sliding plate 4 is located at the first position, the front end 49 is closely contacted to a front wall of the cartridge body, that is, the bearing plate 211, and when the sliding plate 4 is located at the second position, the front end 49 disposed away from the front wall of the cartridge body.

Figure 11:
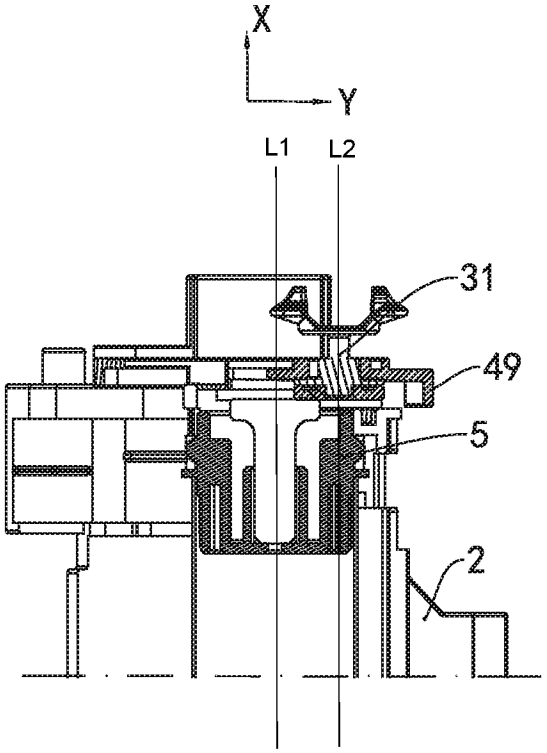
FIG. 11 is a schematic view illustrating a second state of a driving force receiving member.
Figure 10:
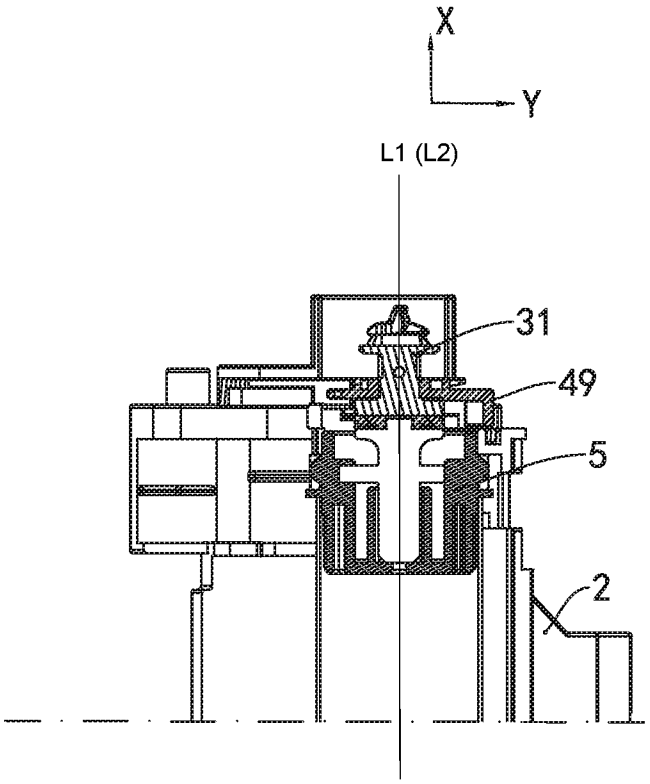
FIG. 10 is a schematic view illustrating a first state of a driving force receiving member.

Referring to FIG. 10 and FIG. 11, these partial cross section views not only show the two different state of the driving force receiving member 31, but also the two different positions of the sliding plate 4. In FIG. 10, the sliding plate 4 is in the first position, at the same time the driving force receiving member 31 are co-axial with the photosensitive drum, i.e., the driving force receiving member 31 is in a co-axial position. In FIG. 11, the sliding plate 4 is in the second position, at the same time, and the driving force receiving member 31 is away from the axis L1 from the photosensitive drum such that the axis L2 of the driving receiving member 31 is parallel with the axis L1 of the photosensitive drum, i.e. the driving receiving member 31 is in a parallel position.

When the sliding plate 4 is located at the first position, the front end 49 is closely contacted to a front wall of the cartridge body, that is, the bearing plate 211, and when the sliding plate 4 is located at the second position, the front end 49 disposed away from the front wall of the cartridge body.

It is understood that, if viewing upon the X direction, when the driving force receiving member 31 is in the co-axial position, it is disposed within the drum gear 5, but when the driving receiving member 31 is in the parallel position, at lease part of the driving force receiving member 31 is disposed out of the drum gear 5 in the Y direction. This would help the demounting of the process cartridge more easily.

In the process of placing the process cartridge 2 into the cartridge containing chamber or taking the process cartridge 2 out of the cartridge containing chamber, when the driving force receiving member 31 receives a force in the Y or axial direction, the driving force receiving member 31 can move between the co-axial position and the parallel position, wherever it moves, its axis is always co-axial or parallel with the axis of the photosensitive drum; the movement may be translation of the driving force receiving member 31 relative to the process cartridge or translation plus rotation relative to the X direction thereof within a range limited by the rotation angle limiting mechanism, that is, a rotation angle is generated in the peripheral direction. In this way, the foregoing clamping phenomenon when the process cartridge is placed into the cartridge containing chamber or taken out of the cartridge containing chamber is avoided by means of radial movement and/or a peripheral rotation angle.

Second Embodiment of a Process Cartridge

Figure 12:
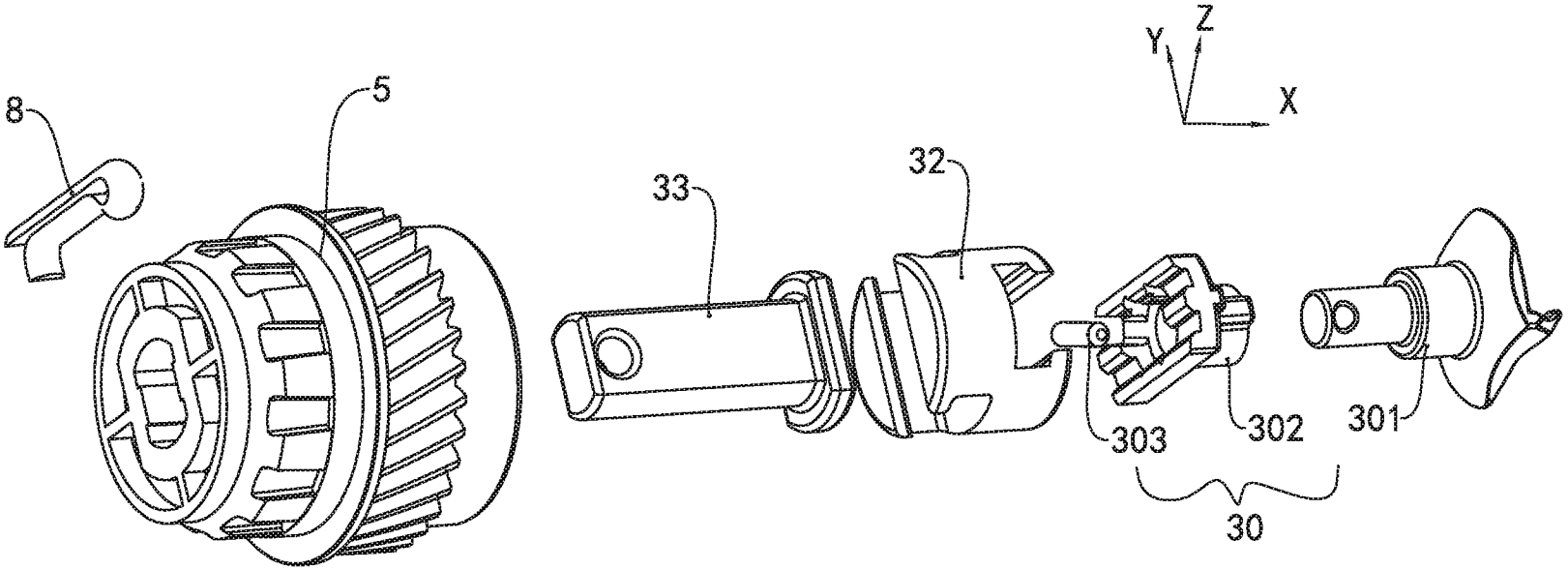
FIG. 12 is a structural exploded view of a driving force receiving member, a Oldham coupling, and a rotation angle limiting mechanism in a second embodiment of the process cartridge of the present invention.

This embodiment is partially the same as the first embodiment of the process cartridge, and the difference is described below. Referring to FIG. 12, the manner of connection between the force transmission rod 33 and the drum gear 5 is making the assembled force transmission rod 33 and drum gear 5 fixed to each other by using a pin 8; further both the force transmission rod 33 and the hole provided on drum gear 5 to engage with the force transmission rod 33 have non-circular cross sections. That is, the force transmission rod 33 cannot move or rotate in a three-dimensional coordinate system relative to the drum gear 5. However, a driving force receiving member 30 of this embodiment consists of a pin 303, a shaft left end 302, and a shaft right end 301. The shaft left end 302 has a shaft hole for the shaft right end 301 to pass through, and after the pin 303 is mounted on a pin hole of the shaft right end 301, the shaft right end 301 is enabled to rotate by an angle around the axis relative to the shaft left end 302. That is, the rotation angle limiting mechanism is disposed between the shaft portion of the driving force receiving member 30 and the Oldham coupling which in this embodiment includes the shaft left end 302, the slide member 32 and a right shaft end of the force transmission rod 33.

Figure 13:
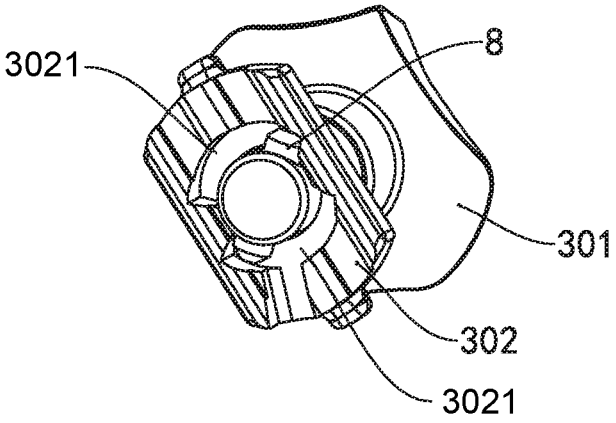
FIG. 13 is a perspective view illustrating a rotation angle limiting mechanism in the second embodiment of the process cartridge of the present invention.

Referring to FIG. 13, it can be seen that on the one hand, the pin 8 disposed in two fan-shaped grooves 3021 of the shaft left end 302 limits the movement of the shaft right end 301 in the X axial direction relative to the shaft left end 302 and on the other hand, the pin 8 and the two fan-shaped grooves together limit a rotation angle range between the shaft right end 301 and the Oldham coupling. If taking the shaft right end 301 as an independent driving force receiving member, then the rotation angle limiting mechanism is disposed between this corresponding driving force receiving member and the Oldham coupling.

For this embodiment, because the driving force receiving member 30 is manufactured in a split manner, before assembly, the sliding plate 4 can be mounted on the right shaft end 301 in advance. Therefore, the mounting groove 48 of the sliding plate 4 in the first embodiment may be omitted, thereby improving the anti-deformation rigidity of the sliding plate 4 made of plastics.

Apparently, for this embodiment, the force transmission rod 33 may be a protruding bar formed on a right side end surface of the drum gear 5, provided that the protruding bar matches the slide member 32 to facilitate the formation of a Oldham coupling.

Third Embodiment of a Process Cartridge

Figure 14:
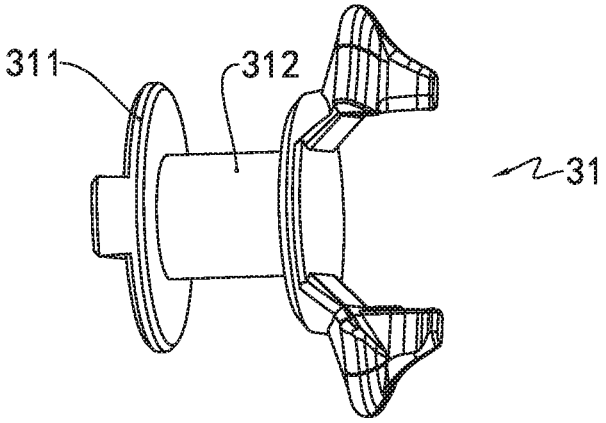
FIG. 14 is a structural view of a driving force receiving member in a third embodiment of the process cartridge of the present invention.

Referring to FIG. 14, this embodiment differs from the first embodiment of the process cartridge in that the shaft portion of the driving force receiving member has only a cylinder portion 312, but no elliptical cylinder portion at all. To solve the problem of assembly with the sliding plate 4, the left shaft end 311 and other parts are manufactured in a split manner, and the advantage is reducing the manufacturing costs. In addition, the sliding plate 4 also uses the structure like that in the second embodiment of the process cartridge.

Other Implementations of the Process Cartridge

A draw spring 6 used as the elastic member of the present invention is not necessary, and completely can be omitted. In addition, an elastic means in other forms may also be used, provided that after the process cartridge leaves the cartridge containing chamber, the sliding plate 4 is enabled to be at the first position.

The torsion spring 7 is not necessarily disposed. In the state in which the torsion spring 7 is not disposed, the function of the rotation angle limiting mechanism is not lost.

INDUSTRIAL APPLICABILITY

In the process of mounting the process cartridge into the cartridge containing chamber or demounting the process cartridge from the cartridge containing chamber in the present invention, that is, in the process in which the process cartridge 2 moves in the Y direction shown in FIG. 1 relative to the electrophotographic image forming apparatus 1 for engagement or disengagement, the position of engaging teeth of the driving force receiving member as measured in the X direction always remain unchanged. In the mounting and demounting process, once the engaging teeth are clamped or abutted dead with the rotational force driving head, the problem is resolved by making the engaging teeth rotate by an angle around the X or the axis direction, or a compound movement of translation along the Y direction at the same time.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A process cartridge, comprising a cartridge body, a photosensitive drum having a first axis, and a driving force receiving member having a second axis, wherein the photosensitive drum is rotatably supported between two end walls of the cartridge body, and the driving force receiving member comprises a head portion and a shaft portion;

wherein the driving force receiving member is connected to an axial end of the photosensitive drum through an Oldham coupling;

a rotation angle limiting mechanism is disposed between the driving force receiving member and the photosensitive drum to regulate a relative rotation of the driving force receiving member with respect to the photosensitive drum; and the driving force receiving member is movable in a direction perpendicular to the first axis and rotatable around the second axis such that the second axis is either co-axial or parallel with the first axis;

the shaft portion further comprises a guided portion formed by an elliptical cylinder portion;

the process cartridge further comprises a sliding plate disposed on one of the end walls of the cartridge body, and is provided with a round hole;

the shaft portion further comprises an engaging portion formed by a cylinder portion; the guided portion is disposed between the engaging portion and the head portion; and the round hole is in engagement with the engaging portion;

wherein the sliding plate is slidable between (i) a first position in which the second axis is co-axial with the first axis and (ii) a second position in which the second axis is parallel with the first axis.

2. The process cartridge according to claim 1, wherein the sliding plate is provided with a guiding groove that extends from an edge of the sliding plate to the round hole for guiding the guided portion into the round hole, a width of the guiding groove is slightly greater than a short axis of the elliptical cylinder portion.

3. The process cartridge according to claim 1, wherein the rotation angle limiting mechanism is disposed between the photosensitive drum and the Oldham coupling.

4. The process cartridge according to claim 1, wherein the rotation angle limiting mechanism is disposed between the shaft portion of the driving force receiving member and the Oldham coupling.

5. The process cartridge according to claim 1, further comprising an elastic member, wherein the elastic member forces the sliding plate to be located at the first position.

6. The process cartridge according to claim 1, wherein when the sliding plate is at the second position, the sliding plate goes beyond a front wall of the cartridge body.

7. The process cartridge according to claim 1, wherein a driving force transmitting portion of the driving force receiving member is partially outside a drum gear of the photosensitive drum in the direction perpendicular to the first axis.

8. The process cartridge according to claim 1, wherein the Oldham coupling includes an outer coupling adjacent to the shaft portion; when the sliding plate is in the second position, the outer coupling is at least partially out of the photosensitive drum, viewing along the first axis.

9. An electrophotographic image forming apparatus, comprising a main body, wherein the main body is provided therein with a cartridge containing chamber, and the cartridge containing chamber is used for placing and taking the process cartridge according to claim 1.

10. A process cartridge, comprising a cartridge body, a photosensitive drum having a first axis, and a driving force receiving member having a second axis, wherein the photosensitive drum is rotatably supported between two end walls of the cartridge body, and the driving force receiving member comprises a head portion and a shaft portion;

wherein the driving force receiving member is connected to an axial end of the photosensitive drum through an Oldham coupling;

a rotation angle limiting mechanism is disposed between the driving force receiving member and the photosensitive drum to regulate a relative rotation of the driving force receiving member with respect to the photosensitive drum; and the driving force receiving member is movable in a direction perpendicular to the first axis and rotatable around the second axis such that the second axis is either co-axial or parallel with the first axis;

the process cartridge further comprises a sliding plate positioned on one of the end walls of the cartridge body, the sliding plate is provided with a round hole; wherein the sliding plate is movable between (i) a first position in which the second axis is co-axial with the first axis and (ii) a second position in which the second axis is parallel with the first axis; and wherein the shaft portion comprises an engaging portion formed by a cylinder portion, and the round hole is in engagement with the engaging portion.

11. The process cartridge according to claim 10, wherein when the sliding plate is at the second position, the sliding plate goes beyond a front wall of the cartridge body.

12. The process cartridge according to claim 10, further comprising an elastic member, wherein the elastic member forces the sliding plate to be located at the first position.

13. The process cartridge according to claim 10, wherein a driving force transmitting portion of the driving force receiving member is partially outside a drum gear of the photosensitive drum in the direction perpendicular to the first axis.

14. The process cartridge according to claim 10, wherein the Oldham coupling includes an outer coupling adjacent to the shaft portion; when the sliding plate is in the second position, the outer coupling is at least partially out of the photosensitive drum, viewing along the first axis.

15. The process cartridge according to claim 10, wherein the rotation angle limiting mechanism is disposed between the photosensitive drum and the Oldham coupling.

16. The process cartridge according to claim 10, wherein the rotation angle limiting mechanism is disposed between the shaft portion of the driving force receiving member and the Oldham coupling.

17. An electrophotographic image forming apparatus, comprising a main body, wherein the main body is provided therein with a cartridge containing chamber, and the cartridge containing chamber is used for placing and taking the process cartridge according to claim 10.

* * * * *